United States Patent [19]

Kito et al.

[11] Patent Number: 4,850,202

[45] Date of Patent: Jul. 25, 1989

[54] AUGER-TYPE ICE MAKING MACHINE

[75] Inventors: Yoshikazu Kito; Yashumitsu Tsukiyama; Susumu Tatematsu, all of Toyoake, Japan

[73] Assignee: Hoshizaki Electric Co., Ltd., Japan

[21] Appl. No.: 123,593

[22] Filed: Nov. 20, 1987

[30] Foreign Application Priority Data

May 24, 1985 [JP] Japan ..... 60-111542

[51] Int. Cl.[4] ..... F25C 1/14

[52] U.S. Cl. ..... 62/195; 62/303; 62/354; 73/61 R

[58] Field of Search ..... 62/85, 171, 195, 310, 62/348, 303, 354; 73/61 R; 134/113

[56] References Cited

U.S. PATENT DOCUMENTS

| | | | |
|---|---|---|---|
| 3,369,376 | 2/1968 | Kious | 62/303 X |
| 3,457,504 | 7/1969 | Arthur et al. | 73/61 R X |
| 4,020,677 | 5/1977 | Doddington et al. | 73/61 R |
| 4,296,628 | 10/1981 | Mast | 73/61 R X |
| 4,305,278 | 12/1981 | Stewart et al. | 73/61 R |
| 4,644,757 | 2/1987 | Hida et al. | 62/303 X |

*Primary Examiner*—William E. Tapolcai

*Attorney, Agent, or Firm*—Wenderoth, Lind & Ponack

[57] ABSTRACT

An auger-type ice making machine has a refrigerating cylinder having upper and lower bearings, an auger supported rotatably within the refrigerating cylinder by the upper and lower bearings, a water supply valve for supplying water to the refrigerating cylinder, a drain valve in fluid communication with the refrigerating cylinder for discharging water therefrom, an electric detector assembly including an electrode member having its one end extending into the refrigerating cylinder, and an electric control circuit electrically connected to the electrode member to receive a detection signal from the electric detector assembly. The electric control circuit determines on the basis of the detection signal that the impurity concentration of the water has increased beyond a predetermined level. The water supply valve and the drain valve are electrically connected to the control circuit to be closed and opened, respectively, when the control circuit determines that the impurity concentration of water has increased beyond this predetermined level, thereby interrupting the water supply to the refrigerating cylinder while discharging water therefrom in an automatic manner.

3 Claims, 2 Drawing Sheets

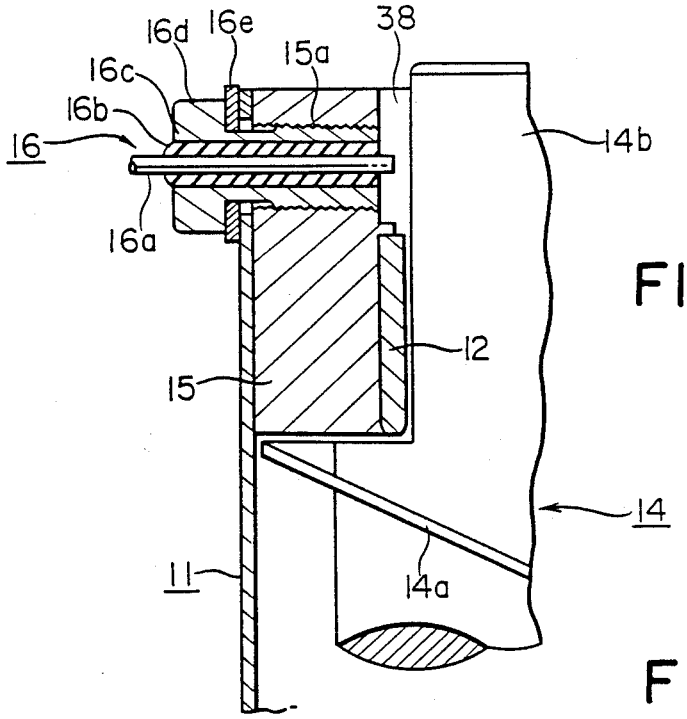
FIG. 2
FIG. 4 (PRIOR ART)
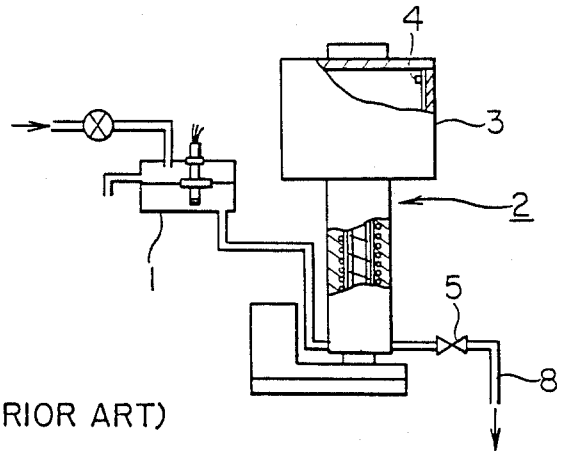
FIG. 5 (PRIOR ART)
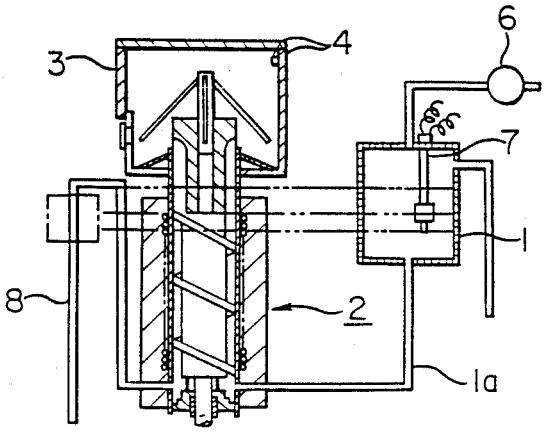

AUGER-TYPE ICE MAKING MACHINE

BACKGROUND OF THE INVENTION

1. Field of the Invention

The present invention relates generally to an auger-type ice making machine and, more particularly, to a novel and improved ice making machine in which a change in the quality of water contained in a refrigerating cylinder for ice formation is electrically detected to thereby cause the water to be discharged from the cylinder in dependence on the result of the detection for the purpose of preventing auger supporting bearings and other parts from being subject to excessive wear.

2. Prior Art

Heretofore, a variety of auger-type ice making mechanisms having various structures have been proposed, as exemplified by those disclosed in Japanese laid-open Utility Model Application Nos. 39,476/1983 and 99,687/1983.

Referring to FIG. 4 of the accompanying drawings showing an ice making machine known heretofore, raw water is supplied to an auger-type ice making mechanism 2 from a water tank 1 which is operated to maintain water at a predetermined level. Ice pieces or pellets as formed by the ice making mechanism are stored in an ice storage chamber 3. When the latter becomes full of the ice pellets, this state is detected by a storage level sensor switch 4, whereby a corresponding detection signal is produced. In response to this signal, a drain valve 5 provided in a drain pipe 8 communicated with the ice making mechanism 2 is opened to thereby allow provably contaminated water within the refrigerating cylinder to be discharged while cleaning the refrigerating cylinder with water supplied from the water tank 1.

Referring to FIG. 5, there is shown another conventional ice making machine, in which the water tank 1 is provided with a water supply pipe incorporating a water supply valve 6 which is opened periodically under the control of a timer independent of the water level detection signal generated by a float switch 7 used for controlling the water level within the water tank 1. By opening the water supply valve 6, the water level within the tank 1 is forced to rise upwardly to thereby cause water within the cylinder of the ice making mechanism 2 to be discharged through a drain pipe 8 under the action of siphonage and replaced by fresh water.

As will be seen, however, each of the prior art ice making machines is so arranged that the water within the refrigerating cylinder is discharged automatically mainly in dependence on a chronographical factor regardless of an actual degree of contamination (or impurity concentration level) of water within the ice making mechanism. Also, in practice, the impurity concentration of water within the refrigerating cylinder is affected by that of the water supplied to the water tank and ice quality (e.g. water content of ice) as manufactured. Nevertheless, in the aforementioned conventional ice making machines, water is discharged from the refrigerating cylinder of the ice making mechanism whenever an ice making operation has been performed over a predetermined period even if the impurity concentration of water is adequately low, i.e. even through there is no need for discharging water from the refrigerating cylinder, which causes significant wasteful consumption of water. Besides, it is to be noted that water within the refrigerating cylinder is usually at a relatively high temperature at the time of starting the ice making operation after a water discharging operation. Consequently, when the water discharge is carried out periodically without consideration of the current water quality, the daily output of the ice making machine will be disadvantageously lowered considerably. On the other hand, the periodical water discharge may also cause such a situation in which the water discharge is not effectuated even when the impurity concentration of water within the refrigerating cylinder has increased excessively after continuation of the ice making operation unless the predetermined discharging time point has been attained. In that case, scales will be deposited on the auger, the refrigerating cylinder, the bearings and other elements of the ice making mechanism, involving degradation in the ice making capability as well as excessive wear in the bearings.

SUMMARY OF THE INVENTION

It is therefore a principal object of the present invention to provide an ice making machine in which increasing of the impurity concentration or content of water within the refrigerating cylinder beyond a predetermined value can be positively detected to thereby cause the contaminated water to be discharged from the refrigerating cylinder.

To achieve the above object, there is provided according to an aspect of the invention, an auger-type ice making machine which comprises a refrigerating cylinder having an upper bearing and a lower bearing mounted at upper and lower ends, respectively, an auger supported rotatably within the refrigerating cylinder by means of the upper and lower bearings, a water supply valve in fluid communication with the refrigerating cylinder for supplying water thereto, a drain valve in fluid communication with the refrigerating cylinder for discharging water therefrom, an electric detector assembly including at least one electrode having one end portion thereof extending into the interior of the refrigerating cylinder, and an electric control circuit electrically connected to the electrode of the detector assembly and supplied with a detection signal from the electric detector assembly, wherein the electric control circuit is adapted to determine on the basis of the detection signal whether or not the impurity concentration of the water has increased beyond a predetermined level.

More specifically, the water supply valve and the drain valve both in fluid communication with the refrigerating cylinder have respective solenoids electrically connected to the control circuit to be thereby closed and opened, respectively, when the control circuit determines that the impurity concentration of water within the refrigerating cylinder has increased beyond the predetermined value, whereupon the water supply to the refrigerating cylinder is interrupted while the water within the refrigerating cylinder is discharged in an automatic manner.

When water containing impurities is cooled, the part of the water which is frozen first is pure. Consequently, in the ice making apparatus such as the auger-type ice making machine in which water is constantly present within the refrigerating cylinder to ensure the continuous ice making process, the impurity concentration of water within the refrigerating cylinder increases as a function of passage of the operation time. Furthermore, the electric resistance of water increases as a function of the impurity concentration. Accordingly, by detecting a voltage drop appearing upon application of a predetermined voltage across impurity containing water by means of the electrical detector assembly and comparing the detection signal represented by the voltage drop with a reference signal representative of a limit concentration value or level to thereby open the drain valve if the limit level is exceeded, it is possible to maintain the impurity concentration of water within the refrigerating cylinder constantly within a predetermined allowable range independent of the quality of raw water and of the manufactured ice.

BRIEF DESCRIPTION OF THE DRAWINGS

In the course of the following detailed description, reference will be made to the attached drawings in which like reference characters designate like or corresponding parts throughout the several views thereof and wherein:

FIG. 2 is an enlarged view of a part of FIG. 1 and shows a portion including a pressure head of the auger-type ice making machine;

FIG. 4 is a view showing schematically a drainage system of a prior art auger-type ice making machine; and FIG. 5 is a view showing schematically a drainage system of another known auger-type ice making machine.

DESCRIPTION OF THE PREFERRED EMBODIMENTS

Figure 1:
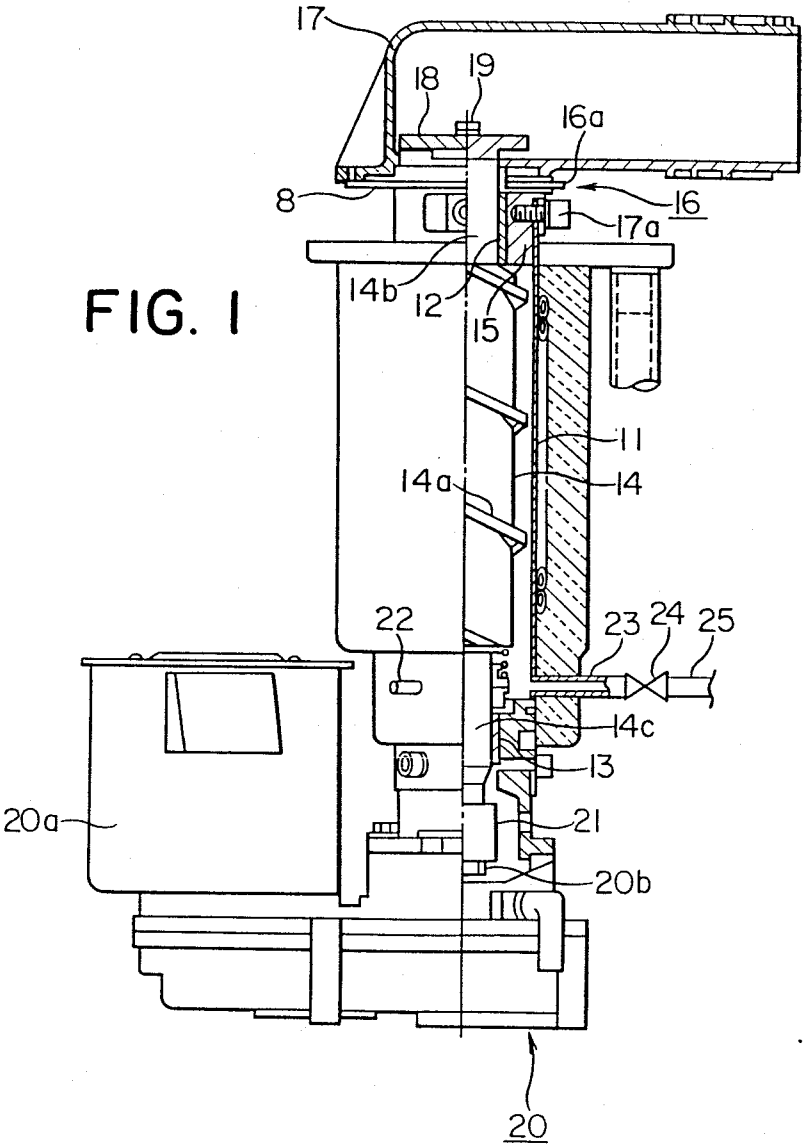
FIG. 1 is a schematic elevational view showing partially in section an auger-type ice making machine according to an embodiment of the present invention.

Now, referring to the drawings and particularly to FIGS. 1 and 2, there is shown an auger type ice making machine according to a preferred embodiment of the present invention. In these figures, there is shown an ice making mechanism of a well known structure including a refrigerating cylinder 11 of a substantially cylindrical configuration enclosed by a heat insulation material, upper and lower bearings 12 and 13 fixedly mounted within the refrigerating cylinder 11 at upper and lower ends thereof, respectively, and an auger 14 which is composed of an auger-like blade 14*a* and upper and lower shaft portions or journals 14*b* and 14*c* supported rotatably within these bearings 12 and 13, respectively.

The upper annular bearing 12 is fitted into the center opening formed in a substantially annular pressure head 15 which per se is well known in the art and fixedly mounted within the refrigerating cylinder at a top portion thereof by means of bolts 17*a*, and the uppershaft portion 14*b* of the auger 14 is rotatably supported within the upper bearing 12, while the lower shaft portion 14*c* of the auger 14 is rotatably supported within the lower annular lower annular bearing 13.

As best shown in FIG. 2, there is disposed in the pressure head 15 at an upper portion thereof an electric detector assembly 16 having a bar-like electrode 16*a* which assembly extends radially through the side walls of the refrigerating cylinder 11 and the pressure head 15. The upper shaft portion 14*b* mentioned above extends through the upper bearing 12 fitted in the center opening of the pressure head 15 into an ice discharge port 17 provided on the top end of the refrigerating cylinder 11. Further mounted on the top end of the upper shaft portion 14*b* by means of bolts 19 is a rod-like cutter member 18 which serves to break ice columns into ice pieces of a predetermined length, the ice columns being produced upon passing through ice compression passages (not shown) formed in the pressure head 15.

A drive unit 20 including a drive motor 20*a* having an output shaft 20*b* is disposed below the refrigerating cylinder 11, and the output shaft 20*b* of the drive motor 20*a* is coupled to the lower shaft portion 14*c* of the auger 14 by means of a spline joint member 21. Thus, the auger 14 can be rotated by operating the drive motor 20*a*.

Connected to the refrigerating cylinder 11 at the bottom thereof are a water supply pipe or tube 22 and a water drain tube 23 in fluid communication with the interior of the refrigerating cylinder 11, and the drain tube 23 is provided with a drain valve 24 having a drain hose 25, which valve 24 is adapted to be opened and closed under the control of a control circuit as described hereinafter.

Now, turning to the details of the electric detector assembly 16 by referring to FIG. 2, the electrode 16*a* is held coaxially by a metallic electrode holder 16*c* with an insulation material 16*b* being interposed therebetween, which holder 16*c* in turn is screw thread mounted in a threaded hole 15*a* formed so as to extend radially through the pressure head 15 at an upper end portion thereof. A water-proof packing 16*e* is interposed between a flange portion 16*d* of the electrode holder 16*c* and the outer peripheral surface of the refrigerating cylinder 11.

Figure 3:
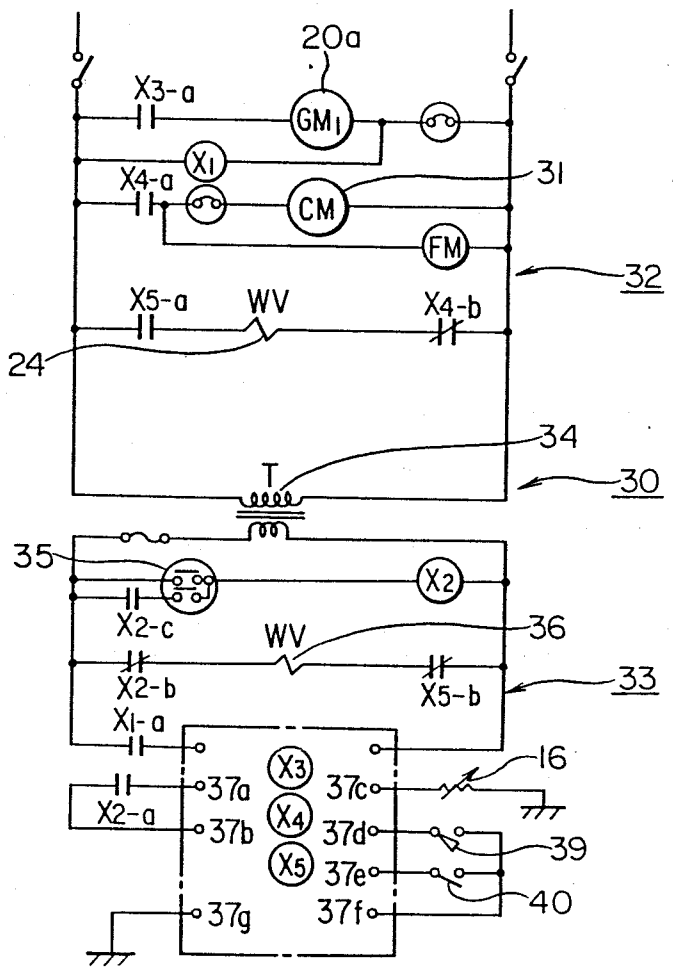
FIG. 3 is a diagram showing a circuit arrangement for controlling operation of the auger-type ice making machine according to the embodiment of the invention.

Next referring to FIG. 3, a description will be given of the control circuit 30 for controlling the drain valve 24, the drive motor 20*a* and others. The control circuit 30 includes a high-voltage circuit portion 32 which is constituted by the drive motor 20*a* for driving the auger 14 and connected in series to a normally open contact $X_{3-a}$ of a third relay $X_3$, a compressor 31 connected in series to a normally open contact $X_{4-a}$ of a fourth relay $X_4$, and a solenoid of the drain valve 24 connected in series to a normally open contact $X_{5-a}$ of a fifth relay $X_5$ and a normally closed contact $X_{4-b}$ of a fourth relay $X_4$, and the series connections described above are connected in parallel to a power supply source. The high voltage circuit portion 32 is electrically coupled to a low voltage circuit portion 33 through a transformer 34. The low voltage circuit portion 33 includes a float switch 35 connected in series to a second relay $X_2$, which switch 35 is disposed within a water tank (not shown) for containing water to be supplied to the interior of the refrigerating cylinder 11 through the water supply pipe 22 shown in FIG. 1. Furthermore, in the low voltage circuit portion 33, a solenoid of the water supply valve 36 disposed in a not shown pipe to supply the water into the water tank (not shown) is connected in series to a normally closed contact $X_{2-b}$ of the second relay $X_2$ and a normally closed contact $X_{5-b}$ of the fifth relay $X_5$. Additionally, a master control circuit portion 37 provided on a substrate is connected in series to a contact $X_{1-a}$ of the first relay.

The master control circuit portion 37 includes the third, fourth and fifth relays $X_3$, $X_4$ and $X_5$ and is provided with terminals 37*a* and 37*b* which are connected in series through the contact $X_{2-a}$ of the second relay $X_2$ together with a terminal 37*c* connected to the electric detector assembly 16. With the structure shown in FIG. 2, an electrical conduction path is established between the electrode bar 16*a* and the upper shaft portion 14b of the auger 14 by way of the water existing therebetween, and the upper shaft portion 14b serves as the earth potential electrode.

The master control circuit portion 37 has additional terminals 37d and 37e connected, respectively, to an ice storage level detection switch 39 and a cylinder cleaning switch 40. Furthermore, a terminal 37f is also connected to the terminals 37d and 37e through the switches 39 and 40, respectively. A terminal 37g is connected to the ground.

In the operation of the auger-type ice making machine according to the invention, the power supply source is first turned on, whereupon the water supply valve 36 is opened to supply the water into the not shown water tank to a predetermined level. This causes the float switch 35 provided in the water tank to be closed with the second relay $X_2$ being electrically energized to close the second normally open contact $X_{2-a}$ and with an ice making operation control timer (not shown) incorporated in the master control circuit portion 37 being activated. At the same time, the third relay $X_3$ is energized, being followed by energization of the fourth relay $X_4$ after a predetermined time delay, whereby the normally open contact $X_{3-a}$ of the third relay $X_3$ and the normally open contact $X_{4-a}$ of the fourth relay are closed to thereby activate the drive motor 20a and the compressor 31 in this sequence. Thus, the ice making operation is started.

After continuation of the ice making operation over a certain time period, the impurity concentration of water utilized for forming ice within the refrigerating cylinder 11 is increased to lower the electric resistance of the water accordingly, resulting in the voltage across the electrode 16a and hence the terminal 37c being lowered. The lowered voltage from the electrode 16a represents a detection signal which is applied to one input of a comparison circuit (not shown) incorporated in the master control circuit portion 37 to be compared with a reference voltage applied to the other input of the comparator. When the voltage difference produced at the output of the comparator drops below a preset level, the ice-making operation control timer (not shown) incorporated in the master control circuit portion 37 is activated. Subsequently, the fourth relay $X_4$ and the third relay $X_3$ are deenergized while the fifth relay $X_5$ is energized, whereby the ice making operation is stopped simultaneously with the closing of the water supply valve 36 and opening of the drain valve 24, resulting in water being discharged from the refrigerating cylinder 11. This water discharging operation is continued for a time preset by an electric drainage timer (not shown) incorporated in the master control circuit portion. Upon passage of the time, the fifth relay $X_5$ is deenergized to cause the drain valve 24 to be closed while opening the water supply valve 36 to start the water supply to the not shown water tank and hence the refrigerating cylinder. Thus, the ice making operation is started again. In this way, the ice making operation can be carried out by using water whose impurity concentration lies always substantially constant within a predetermined range.

It should be mentioned here that the interruption of the water supply and the water discharging operation described above also take place whenever the ice storage level switch 39 is opened by sensing the ice-filled state of an ice storage chamber (not shown) in which the above-mentioned switch 39 is provided. Of course, the ice-making operation is automatically restored under the control of the control circuit described above upon detection of the ice storage level within the ice storage chamber being lowered below a predetermined level.

When water stored within the water system is to be forcibly discharged at the time of service and a cleaning operation for the purpose of maintenance, the cleaning switch 40 can be closed manual, whereupon the water discharge or drainage can be accomplished in accordance with the procedure described above.

In the case of the illustrated embodiment, the description has been given on the assumption that the change in the water quality of the raw water used for ice formation is detected in the form of a voltage change across the terminal 37c for controlling the drain valve 24. It should however be appreciated that the current change may be detected instead of the voltage change to this end. Furthermore, instead of the single electrode 16a, a pair of electrode bars may be employed in the electric detector assembly 16, although not shown, whereby the electric resistance prevailing between the paired electrode bars may be measured to the similar effect. Besides, the control circuit 30 may be conveniently so arranged that an alarm is produced by an alarm circuit (not shown) upon detection of the change in the water quality by the electric detector assembly 16.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What we claim is:

1. An auger-type ice making machine comprising:

a refrigerating cylinder having an upper bearing and a lower bearing mounted within upper and lower ends thereof, respectively;

an annular pressure head mounted within said refrigerating cylinder between the upper end portion thereof and said upper bearing for compressing ice flakes scraped off the inner surface of said refrigerating cylinder, said annular pressure head being radially spaced from said upper bearing to define an annular space therebetween;

an auger having upper and lower journal portions and supported rotatably within said refrigerating cylinder by said upper and lower bearings at said upper and lower journal portions, respectively;

a drain valve in fluid communication with said refrigerating cylinder for discharging water therefrom;

an electric detector assembly including at least one electrode member having one end portion thereof extending radially through the wall of said refrigerating cylinder and said pressure head into said annular space and for producing a detection signal indicating the impurity concentration in the water in said refrigerating cylinder; and electric control circuit means electrically connected to said electrode member to be supplied with the detection signal from said electric detector assembly and connected to said drain valve and including means to determine on the basis of said detection signal that the impurity concentration of the water has increased beyond a predetermined level and to thereupon cause said drain valve to be actuated to cause the water in said refrigerating cylinder to be discharged.

2. An auger-type ice making machine as claimed in claim 1 further comprising a water supply valve disposed in fluid communication with said refrigerating cylinder for controlling the supply of water thereto, said electric control circuit means being connected to said water supply valve to actuate said water supply valve to open it in response to the determination of said electric control circuit means that the impurity concentration of said water has increased beyond the predetermined level.

3. An auger-type ice making machine as claimed in claim 1 wherein said electric detector assembly includes a pair of electrodes, and means for utilizing a change in electric resistance between said electrodes for producing said detection signal.

* * * * *